US011850864B2

(12) United States Patent
Yoda et al.

(10) Patent No.: US 11,850,864 B2
(45) Date of Patent: Dec. 26, 2023

(54) INKJET HEAD

(71) Applicant: KYOCERA Document Solutions Inc., Osaka (JP)

(72) Inventors: Junya Yoda, Osaka (JP); Junichi Fukuoka, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 199 days.

(21) Appl. No.: 17/678,977

(22) Filed: Feb. 23, 2022

(65) Prior Publication Data

US 2022/0274409 A1 Sep. 1, 2022

(30) Foreign Application Priority Data

Feb. 26, 2021 (JP) ..... 2021-030612

(51) Int. Cl.
*B41J 2/175* (2006.01)
*B41J 2/16* (2006.01)

(52) U.S. Cl.
CPC ..... *B41J 2/175* (2013.01); *B41J 2/1623* (2013.01)

(58) Field of Classification Search
CPC ..... B41J 29/38; B41J 2/14233; B41J 2/1623; B41J 2/18; B41J 2/175; B41J 2202/08; B41J 2/16585; B41J 2202/21
See application file for complete search history.

(56) References Cited

U.S. PATENT DOCUMENTS 8,277,030 B2 * 10/2012 Nagate ..... B41J 2/04581 347/68
10,994,543 B2 * 5/2021 Kameshima ..... B41J 2/1404
11,724,501 B2 * 8/2023 Yoda ..... B41J 2/14233 347/17

FOREIGN PATENT DOCUMENTS

JP 2017-217823 A 12/2017

* cited by examiner

*Primary Examiner* — An H Do
(74) *Attorney, Agent, or Firm* — Stein IP LLC

(57) ABSTRACT

An inkjet head includes a back end part, a front end part, and a heating plate. The back end part includes an ink passage. The back end part is fed with ink and delivers the fed ink. The front end part is supplied with ink from the back end part. The front end part includes nozzles. The heating plate includes a heating element to produce heat by electricity. The heating plate is disposed between the back end part and the front end part. The heating plate conducts heat from the other side of plane so as to heat the front end part. The heating plate conducts heat from one side of plane so as to heat the back end part.

15 Claims, 10 Drawing Sheets

INKJET HEAD

INCORPORATION BY REFERENCE

This application is based upon and claims the benefit of priority from the corresponding Japanese Patent Application No. 2021-030612 filed Feb. 26, 2021, the entire contents of which are hereby incorporated by reference.

BACKGROUND

The present disclosure relates to an inkjet head that ejects ink.

An inkjet type image forming apparatus includes a member called a head. The head has a plurality of nozzles. Ink is ejected through the nozzle. The viscosity of ink varies depending on temperature. For instance, if the temperature of ink is low, ink ejection rate may become insufficient. Therefore, a heater for heating ink may be disposed.

SUMMARY

An inkjet head according to one aspect of the present disclosure includes a back end part, a front end part, and a heating plate. The back end part includes an ink passage. The back end part is fed with ink and delivers the fed ink. The front end part is supplied with the ink from the back end part. The front end part includes a plurality of nozzles. The plurality of nozzles are aligned in a main scanning direction so as to eject ink. The heating plate includes a heating element to produce heat by electricity. The heating plate is disposed between the back end part and the front end part. The heating plate conducts heat from the other side of plane so as to heat the front end part. The heating plate conducts heat from one side of plane so as to heat the back end part.

Other objects of the present disclosure and specific advantages obtained by the present disclosure will become more apparent from the description of the embodiment given below.

DETAILED DESCRIPTION

Figure 1:
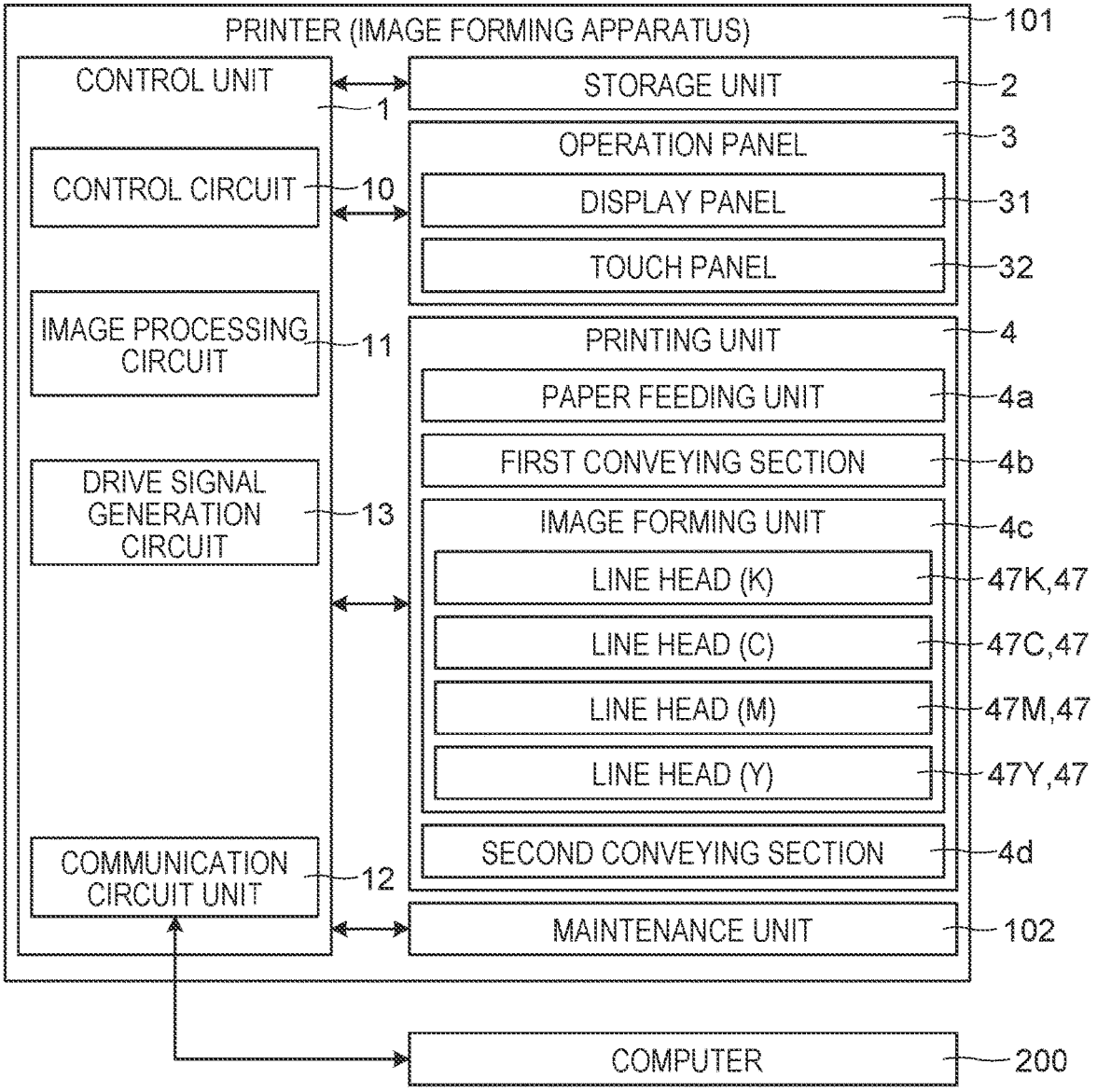
FIG. 1 is a diagram illustrating an example of a printer according to an embodiment.

Hereinafter, with reference to FIGS. 1 to 10, described is an image forming apparatus equipped with an inkjet head

100 and an inkjet head 100 according to the present disclosure. The inkjet head 100 ejects ink. In the following example, a printer 101 is exemplified and described as the image forming apparatus. Note that the present disclosure can be applied not only to the printer but also to other image forming apparatus such as a multifunction peripheral.

Prior to describing the image forming apparatus equipped with the inkjet head 100 and the inkjet head 100 according to this embodiment, a conventional inkjet head is first described below.

When printing is performed, ink is ejected through nozzles. After ejecting ink, the nozzles are refilled with ink. Cold ink may be refilled. In addition, when one sheet of paper is printed, the number of ejection times is different among the nozzles. The ink temperature may vary among the nozzles due to the number of ink ejection times. In view of improving image quality and equalizing ink ejection rate, it is preferred to minimize an ink temperature difference among the nozzles.

Therefore, in a conventional technique, for example, a plurality of heaters and a plurality of temperature sensors may be disposed so that the ink temperature difference becomes as small as possible. A plurality of adjacent nozzles constitute one group, and every nozzle is assigned to one of the groups. Further, the heater and the temperature sensor are disposed in each group. However, the ink temperature in the nozzle is affected by various factors such as ejection state (ejection frequency) and ambient temperature. Ink temperature variation of each nozzle is complicated. It is substantially impossible to dispose the heater and the temperature sensor for each nozzle. There is a problem that it is difficult to reduce the ink temperature difference among all the nozzles.

Note that the conventional type of head equipped with a plurality of heaters and a plurality of temperature sensors causes a complicated structure of the head and increased cost for manufacturing.

In view of the above-mentioned problem, as described below in this embodiment, ink temperature before ejection is equalized among the nozzles, so as to prevent deterioration in image quality due to the ink temperature difference among the nozzles.

In the following description, a three-dimensional orthogonal coordinate system (XYZ coordinate system) is used for description. In the following description, an X axis direction is a main scanning direction. The main scanning direction is a direction in which nozzles 5 are aligned. AY axis direction is a sub scanning direction. The Y axis direction is also a direction in which a paper sheet is conveyed with respect to the inkjet head 100. The Y axis direction is a direction orthogonal to the X axis direction. AZ axis direction is a direction orthogonal to the X axis direction and to the Y axis direction. The Z axis is also a direction in which the nozzle 5 and the conveyed paper sheet face each other. The plane including the X axis direction and the Y axis direction is parallel to a horizontal plane, for example. In this case, the Z axis direction is the vertical direction (up and down direction).

The XYZ directions are shown in some diagrams. In the following description and drawings, the +X direction indicates one side in the X axis direction. The −X direction indicates the other side in the X axis direction. The +Y direction is one side in the Y axis direction and indicates an upstream side in a paper sheet conveying direction. The −Y direction is the other side in the Y axis direction and indicates a downstream side in the paper sheet conveying direction. The +Z direction is one side in the Z axis direction.

When the printer 101 is installed on a horizontal plane, the +Z direction is the upward direction. The −Z direction is the other side in the Z axis direction. When the printer 101 is installed on a horizontal plane, the −Z direction is the downward direction. Note that, in this description, being parallel includes being substantially parallel. In addition, being vertical includes being substantially vertical. However, these directions are defined for convenience of description. These directions do not limit directions when the inkjet head 100 and the printer 101 are manufactured or used.

(Outline of Printer 101)

Figure 2:
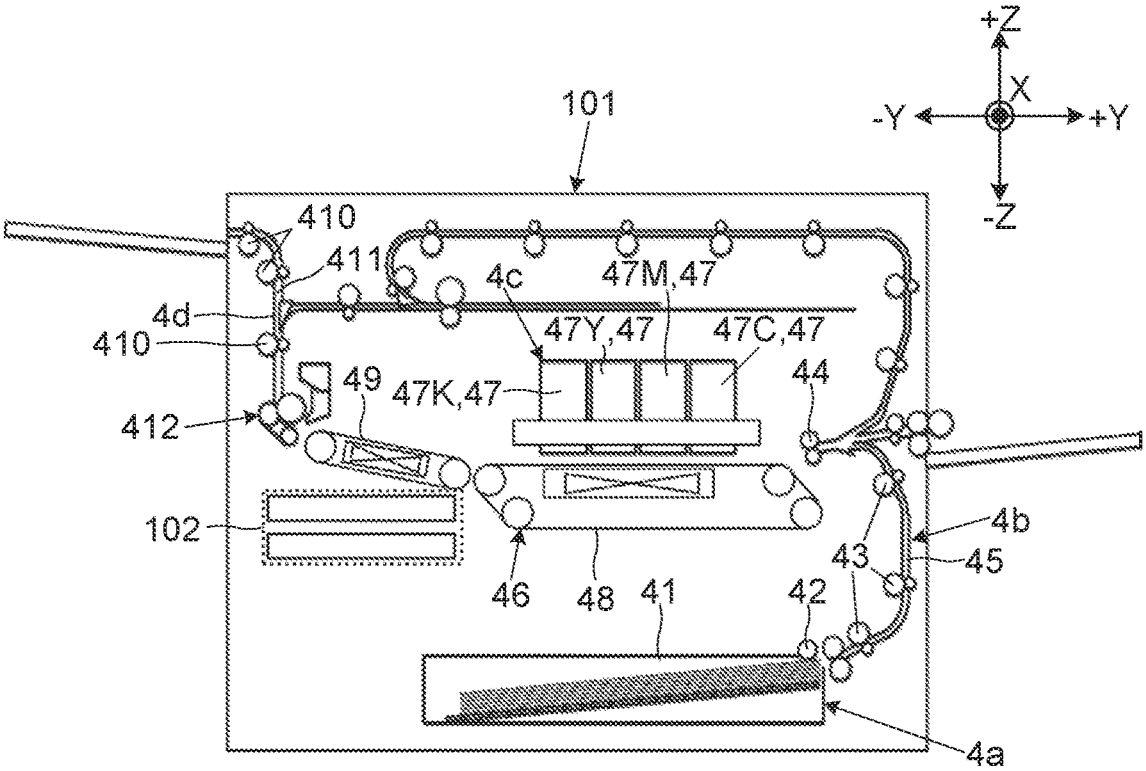
FIG. 2 is a diagram illustrating an example of the printer according to the embodiment.

First, with reference to FIGS. 1 and 2, outline of the printer 101 according to the embodiment is described below. FIGS. 1 and 2 are diagrams illustrating an example of the printer 101 according to the embodiment.

The printer 101 includes a control unit 1, a storage unit 2, an operation panel 3, a printing unit 4, and a maintenance unit 102. The control unit 1 controls individual units of the printer 101. For instance, the control unit 1 is a circuit board. The control unit 1 includes a control circuit 10 and an image processing circuit 11. For instance, the control circuit 10 is a CPU. On the basis of a program and control data stored in the storage unit 2, the control circuit 10 performs calculation and processing. The image processing circuit 11 performs image processing on image data that is used for printing, so as to generate ink ejection image data. The printer 101 includes a ROM, a storage drive (HDD and/or SSD), and a RAM, as the storage unit 2.

A communication circuit unit 12 includes a communication connector, a communication control circuit, and a communication memory. The communication memory stores communication software. The communication circuit unit 12 communicates with a computer 200. The computer 200 is a PC or a server for example. The control unit 1 receives print data from the computer 200. The print data includes print setting data and print content description data. For instance, the print data includes data written in a page description language. The control unit 1 (image processing circuit 11) generates image data (raster data) on the basis of the received (input) print data. The control unit 1 processes the generated image data so as to generate the ink ejection image data.

The operation panel 3 includes a display panel 31 and a touch panel 32. The control unit 1 controls the display panel 31 to display a setting screen and information. The display panel 31 displays operation image such as keys, buttons, or tubs. The touch panel 32 detects a touch operation on the display panel 31. On the basis of output of the touch panel 32, the control unit 1 recognizes an operated operation image. The control unit 1 recognizes user's setting operation.

The printer 101 includes the printing unit 4. The printing unit 4 includes a paper feeding unit 4*a*, a first conveying section 4*b*, an image forming unit 4*c*, a second conveying section 4*d*, and the maintenance unit 102. When executing a print job, the control unit 1 controls operation of the printing unit 4.

The paper feeding unit 4*a* includes a paper feed cassette 41, a sheet feed roller 42, and a paper feed motor (not shown). The paper feed cassette 41 is disposed in a lower part inside main body of the printer 101. The paper feed cassette 41 stores a plurality of recording media. In the following description, paper sheets are used as the recording media, as an example. Note that, the printer 101 can print on a recording medium other than the paper sheet. In this case, the recording media other than paper sheets are set in the paper feed cassette 41. The sheet feed roller 42 contacts with the paper sheet set in the paper feed cassette 41. When printing is performed, the control unit 1 controls the paper feed motor to rotate so that the sheet feed roller 42 rotates. The sheet feed roller 42 sends out the paper sheet.

The first conveying section 4*b* conveys the paper sheet sent out from the paper feed cassette 41 to the image forming unit 4*c*. The first conveying section 4*b* includes a plurality of first convey roller pairs 43, a registration roller pair 44, a first convey motor (not shown), a first conveying path 45, and a first conveying unit 46. When printing is performed, the control unit 1 controls the first convey motor to rotate. In this way, the first convey roller pair 43 rotates, and the paper sheet is conveyed. The first conveying path 45 is a paper sheet conveying path formed by a convey guide. The registration roller pair 44 is disposed at a downstream end of the first conveying section 4*b* in the paper sheet conveying direction. Further, the first conveying unit 46 is disposed at the downstream side of the registration roller pair 44 in the paper sheet conveying direction.

The registration roller pair 44 corrects skew of the paper sheet that has reached the same. The registration roller pair 44 sends out the paper sheet to the first conveying unit 46. The image forming unit 4*c* includes a plurality of line heads 47. For instance, the image forming unit 4*c* includes a line head 47K that ejects black ink, a line head 47C that ejects cyan ink, a line head 47M that ejects magenta ink, and a line head 47Y that ejects yellow ink. Each line head 47 is disposed at an upper side (+Z direction) of the first conveying unit 46. On the basis of the ink ejection image data, each line head 47 ejects ink so that an image is formed (recorded) on the paper sheet.

The first conveying unit 46 includes a conveyor belt 48. The conveyor belt 48 is stretched around a plurality of first belt rollers. When printing is performed, the control unit 1 controls a conveying unit motor (not shown) to rotate so that the first belt roller rotates. In this way, the conveyor belt 48 turns. The paper sheet on the conveyor belt 48 is conveyed. The paper sheet passes below the image forming unit 4*c*.

The second conveying section 4*d* includes a second conveying unit 49, a plurality of second convey roller pairs 410, a second convey motor (not shown), and a second conveying path 411. The second conveying section 4*d* conveys the paper sheet after passing the image forming unit 4*c* to a discharge tray. The first conveying unit 46 sends the paper sheet with ink ejected by the image forming unit 4*c* to the second conveying unit 49. The second conveying unit 49 dries the ink ejected to the paper sheet.

A decurler unit 412 is disposed on the downstream side of the second conveying unit 49 in the paper sheet conveying direction. The decurler unit 412 corrects a curl of the paper sheet. The second conveying path 411 is disposed on the downstream side of the decurler unit 412 in the paper sheet conveying direction. The second conveying path 411 is a paper sheet conveying path formed by the convey guide. The second convey roller pairs 410 are disposed along the second conveying path 411. When printing is performed, the control unit 1 controls the second convey motor to rotate. In this way, the second convey roller pairs 410 rotate so that the paper sheet is conveyed.

For instance, the maintenance unit 102 is disposed below the second conveying unit 49. In maintenance of the inkjet head 100 (the nozzles 5), the first conveying unit 46 moves and retreats, and the maintenance unit 102 moves to below the image forming unit 4*c* (the line heads 47). After the maintenance is completed, the maintenance unit 102 retreats, and the first conveying unit 46 moves to the original position.

(Line Head 47)

Figure 3:
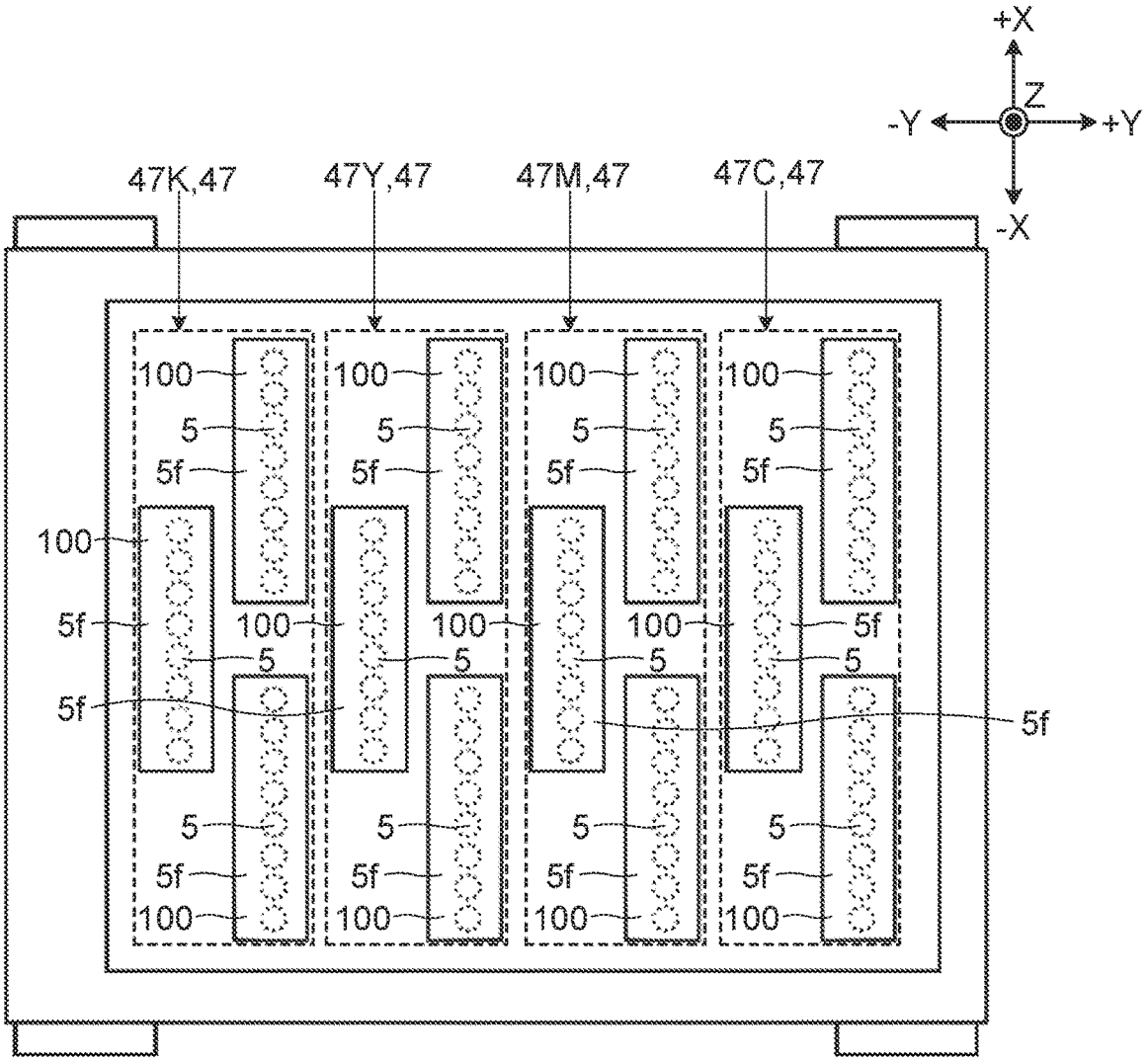
FIG. 3 is a diagram illustrating an example of a line head according to the embodiment.

Next, with reference to FIG. 3, an example of the line head 47 and the inkjet head 100 according to the embodiment is described below. FIG. 3 is a diagram illustrating an example of the line head 47 according to the embodiment. FIG. 3 illustrates an example of the image forming unit 4*c* viewed from below (−Z direction).

As illustrated in FIGS. 1 to 3, the image forming unit 4*c* has a plurality of line heads 47 (47C, 47M, 47Y, and 47K). Individual line heads 47 use inks of different colors, but have the same structure. The line head 47 includes a plurality of inkjet heads 100. A combination of the plurality of inkjet heads 100 is the line head 47. FIG. 3 illustrates an example of the line head 47 including three inkjet heads 100. Note that the line head 47 may be a combination of two inkjet heads 100, or may be a combination of four or more inkjet heads 100.

FIG. 3 illustrates an example in which three inkjet heads 100 of the same color are arranged in the X axis direction (main scanning direction), and among them, two inkjet heads 100 are at the same position in the Y axis direction (sub scanning direction), while the other inkjet head 100 is at a position different from that of the two inkjet heads 100 in the Y axis direction (sub scanning direction). Each inkjet head 100 is supported, and its position is fixed.

Each inkjet head 100 has the plurality of nozzles 5. The nozzle 5 has an opening for ejecting ink. When the printer 101 is installed on a horizontal plane, the nozzle 5 faces downward, and ink is ejected downward. In other words, the opening faces in the −Z direction (downward). Each nozzle 5 faces the conveyed paper sheet and the conveyor belt 48. Each inkjet head 100 is supported so that a distance between the nozzle 5 and the paper sheet or a distance between the nozzle 5 and the conveyor belt 48 becomes a predetermined distance (e.g. 1 mm). The plurality of nozzles 5 are aligned in the X axis direction (main scanning direction). In FIG. 3, circles of broken lines indicate the nozzles 5. Note that, FIG. 3 illustrates the nozzles 5 in a convenience size, but actual size of the nozzle 5 is much smaller. Specifically, viewed from the −Z direction, the plurality of nozzles 5 are formed on the surface (lower surface) of the inkjet head 100. The surface of the inkjet head 100 on which the nozzles 5 are disposed is an ink ejection surface 5*f*.

(Inkjet Head 100)

Figure 4:
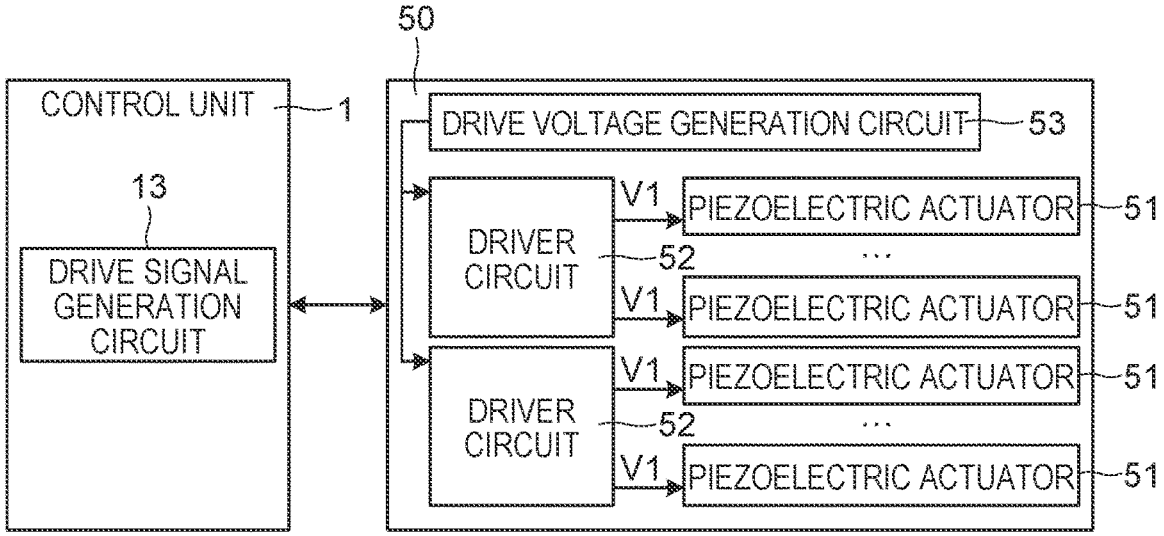
FIG. 4 is a diagram illustrating an example of an inkjet head according to the embodiment.
Figure 5:
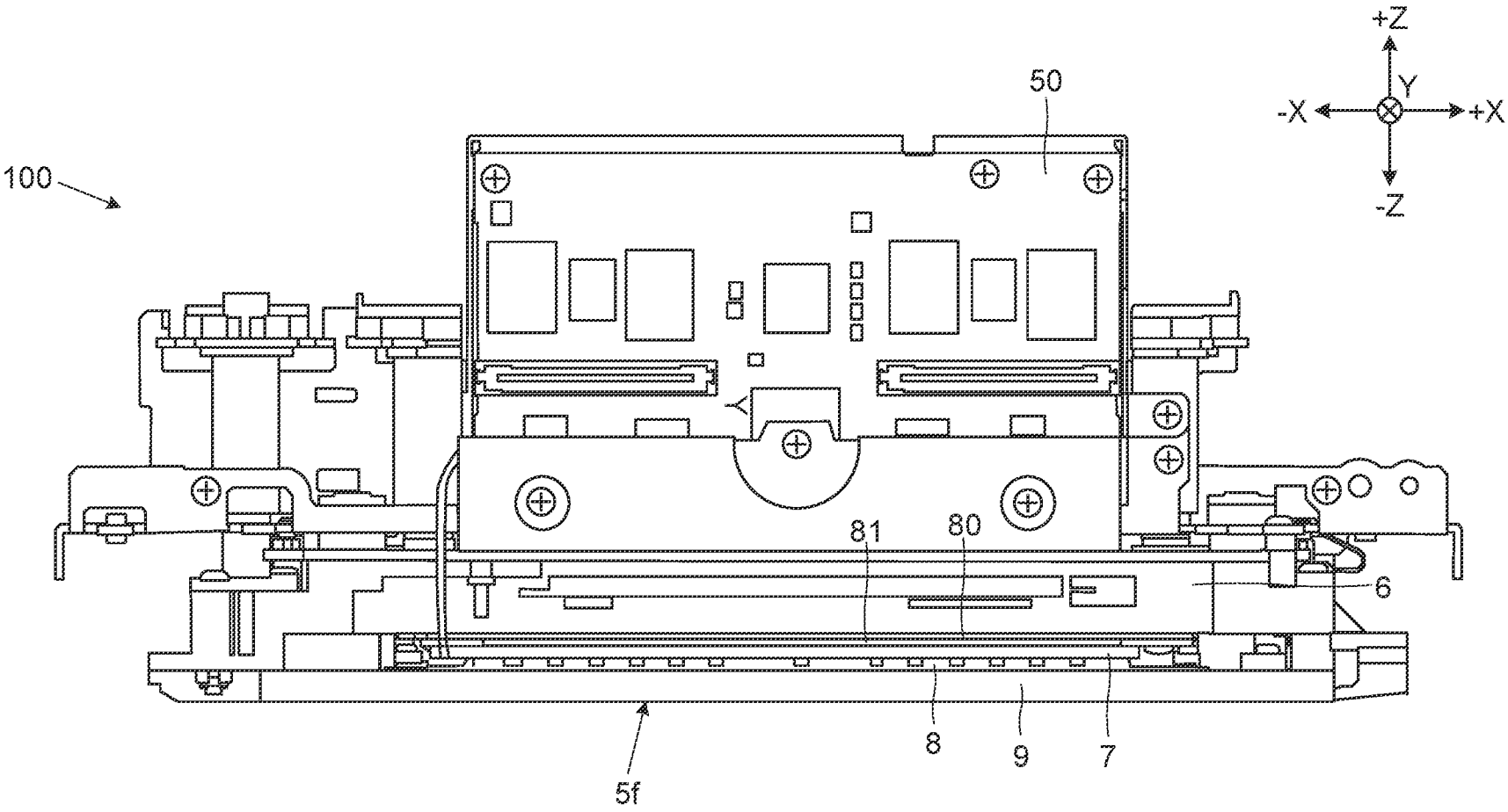
FIG. 5 is a diagram illustrating an example of the inkjet head according to the embodiment.
Figure 6:
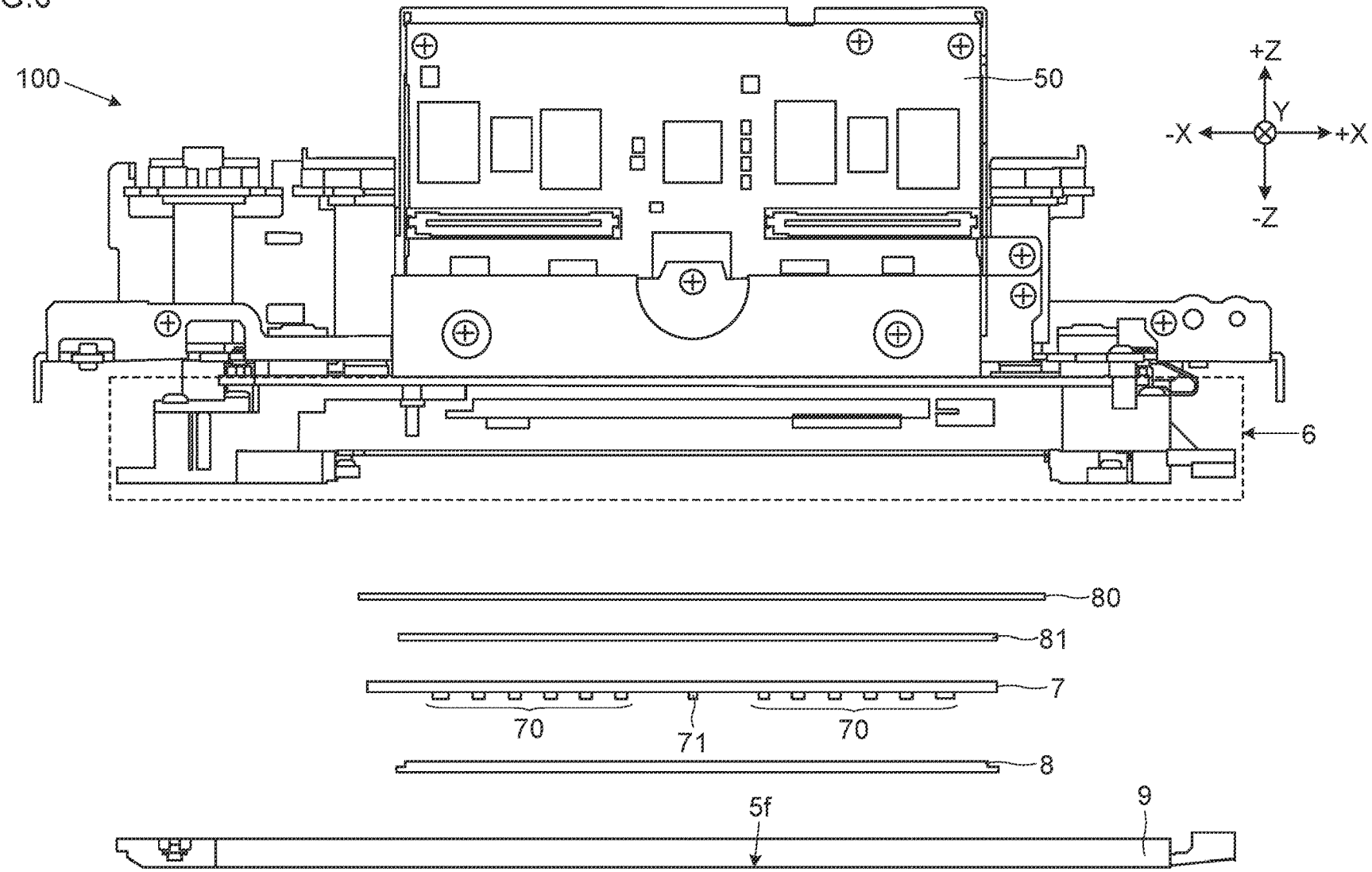
FIG. 6 is a diagram illustrating an example of the inkjet head according to the embodiment.
Figure 7:
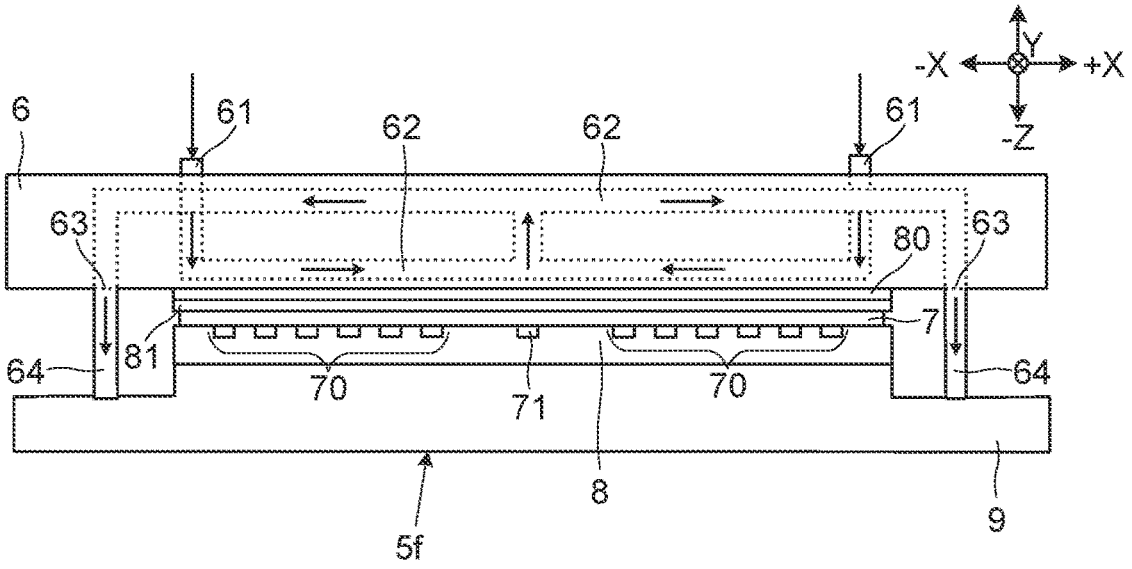
FIG. 7 illustrates an example of a schematic diagram of the inkjet head according to the embodiment.
Figure 8:
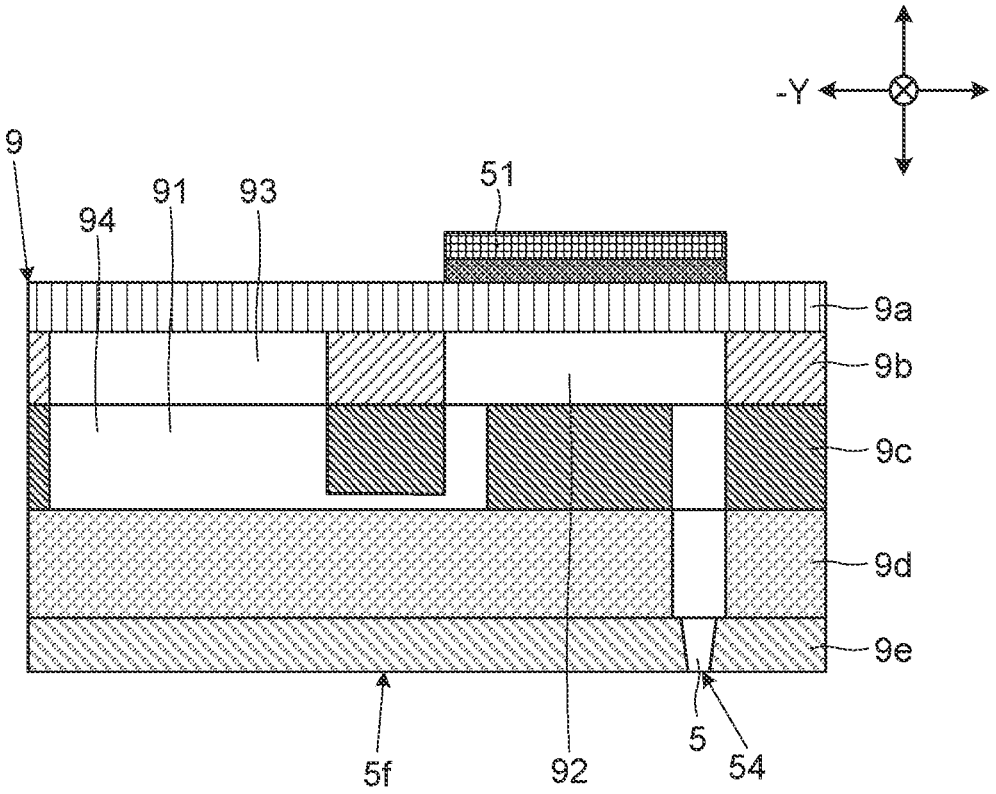
FIG. 8 is a diagram illustrating an example of a front end part according to the embodiment.

Next, with reference to FIGS. 4 to 8, an example of the inkjet head 100 according to the embodiment is described below. FIGS. 4 to 6 are diagrams illustrating an example of the inkjet head 100 according to the embodiment. FIGS. 5 and 6 illustrate an example of the inkjet head 100 viewed from the Y axis direction (sub scanning direction). FIG. 7 illustrates an example of a schematic diagram of the inkjet head 100 according to the embodiment. FIG. 8 is a diagram illustrating an example of a front end part 9 according to the embodiment.

As illustrated in FIG. 4, the inkjet head 100 includes a plurality of piezoelectric actuators 51. For instance, one piezoelectric actuator 51 is disposed for one nozzle 5. The piezoelectric actuator 51 includes a piezoelectric element. The piezoelectric element generates pressure. For instance, the piezoelectric actuator 51 is layers of the piezoelectric elements stacked (in the Z direction). When being applied with a drive voltage V1, each piezoelectric actuator 51 deforms. This deformation causes the ink to be ejected through the nozzle 5.

The inkjet head 100 may include a head circuit board 50. The head circuit board 50 includes, for example, one or more driver circuits 52. FIG. 4 illustrates an example in which the inkjet head 100 (the head circuit board 50) includes the plurality of driver circuits 52. The driver circuit 52 turns on and off application of the voltage to each piezoelectric actuator 51. In the print job, the control unit 1 supplies the ink ejection image data (i.e., data indicating the nozzles 5 to eject ink) to each driver circuit 52. The ink ejection image data is data (binary data) designating ejection or non-ejection of ink through each nozzle 5 (each pixel).

On the basis of ink ejection image data, the driver circuit 52 applies the drive voltage V1 to the piezoelectric actuator 51 of the nozzle 5 to eject ink. When the drive voltage V1 is applied, the piezoelectric actuator 51 deforms. Pressure due to the deformation is applied to an individual passage 92 (passage for ink) corresponding to the nozzle 5. The application of the pressure causes the ink to be ejected through the nozzle 5. In contrast, the driver circuit 52 does not apply the drive voltage V1 to the piezoelectric actuators 51 of the nozzles 5 corresponding to pixels to which ink is not ejected.

The control unit 1 may include a drive signal generation circuit 13 (see FIG. 1). The drive signal generation circuit 13 generates a drive signal. The drive signal is a clock signal, for example. The drive signal is a signal for ejecting ink periodically. The driver circuit 52 may eject ink for one line at every rising edge or falling edge of the drive signal. In addition, the first conveying section 4*b* may convey the paper sheet by a distance of one pixel during one ink ejection period.

The head circuit board 50 may include a drive voltage generation circuit 53. The drive voltage generation circuit 53 may generate a plurality of types of voltages having different voltage values. The voltage generated by the drive voltage generation circuit 53 is supplied to each driver circuit 52. The driver circuit 52 uses the voltage supplied from the drive voltage generation circuit 53 so as to apply the voltage to the piezoelectric actuator 51.

FIG. 5 illustrates an example of the inkjet head 100. FIG. 5 illustrates the example in which the head circuit board 50 is disposed on the upper side (+Z direction side) of the inkjet head 100. FIG. 6 is a partially exploded view of the inkjet head 100 illustrated in FIG. 5.

The rectangular part enclosed by the broken line in FIG. 6 is a back end part 6. As illustrated in FIG. 6, on the −Z direction side (lower side) of the back end part 6, there are disposed a protection plate 80, a adhesive sheet 81, a heating plate 7, a heat transfer sheet 8, and the front end part 9 in order from the +Z direction.

The back end part 6 is fed with ink and delivers the fed ink. As illustrated in FIG. 7, the back end part 6 includes an ink introduction part 61. For instance, two ink introduction parts 61 are disposed on one side and the other side in the X axis direction (main scanning direction). The back end part 6 has an ink passage 62 inside. The ink sent from an ink tank (not shown) enters the ink passage 62 in the back end part 6 through the ink introduction part 61. In FIG. 7, the broken lines show an example of the ink passage 62. For instance, the ink passage 62 is a conduit for flowing ink. In FIG. 7, solid line arrows show directions in which the ink flows.

As illustrated in FIG. 7, the ink that has entered the ink passage 62 moves in the −Z direction (downward) to the center in the X axis direction (main scanning direction). After that, it moves in the +Z direction (upward). Then, the ink passage 62 branches in the +X direction (one side in the main scanning direction) and −X direction (the other side in the main scanning direction). End points of the branched ink passages 62 are ink delivery outlets 63. An ink duct 64 connects the ink delivery outlet 63 to the front end part 9.

The ink delivered from the ink delivery outlet 63 is supplied to the front end part 9 through the ink duct 64.

For instance, the protection plate 80 is a plate disposed between the back end part 6 and the heating plate 7. For instance, the protection plate 80 is a metal plate. A metal having high thermal conductivity can be used for the protection plate 80. For instance, the protection plate 80 is aluminum plate. Material of the protection plate 80 is not limited to aluminum but may be copper, for example. The protection plate 80 has a rectangular shape, for example. In FIG. 6, the longitudinal direction of the protection plate 80 is the X axis direction (main scanning direction). The short direction of the protection plate 80 is the Y axis direction. A plane (XY plane) of the protection plate 80 on the other side (−Z direction) contacts with a plane of the adhesive sheet 81 on one side (+Z direction). The plane (XY plane) of the protection plate 80 on one side (+Z direction) contacts with a lower surface of the back end part 6 (a surface on the −Z direction side parallel to the XY plane). For instance, the lower surface of the back end part 6 is a flat plane. Note that the protection plate 80 may be attached to the back end part 6 using screws.

The adhesive sheet 81 is disposed between the protection plate 80 and the heating plate 7. The adhesive sheet 81 has a rectangular shape, for example. In FIG. 6, the longitudinal direction of the adhesive sheet 81 is the X axis direction (main scanning direction). The short direction of the adhesive sheet 81 is the Y axis direction. The heating plate 7 is also applied to the adhesive sheet 81. For instance, the adhesive sheet 81 is double-sided tape. A surface of the heating plate 7 on one side (+Z direction) is applied to the plane (XY plane) of the adhesive sheet 81 on the other side (−Z direction). In other words, the plane of the adhesive sheet 81 on the other side contacts with a plane of the heating plate 7 on one side. Note that the heating plate 7 may be attached to the inkjet head 100 using screws.

The heating plate 7 is a plate-like member disposed between the adhesive sheet 81 and the heat transfer sheet 8. For instance, the heating plate 7 is a plate equipped with a plurality of heating elements 70. For instance, the heating plate 7 is a circuit board made of glass epoxy resin with a plurality of chip resistors as the heating elements 70. In FIG. 6, the longitudinal direction of the heating plate 7 is the X axis direction (main scanning direction). The short direction of the heating plate 7 is the Y axis direction. A surface of the heating plate 7 on the other side (−Z direction) contacts with the plane (XY plane) of the heat transfer sheet 8 on one side (+Z direction).

The heat transfer sheet 8 is a sheet disposed between the heating plate 7 and the front end part 9. The heat transfer sheet 8 may be a single sheet. The single heat transfer sheet 8 may cover all the heating elements 70. The heat transfer sheet 8 is a sheet having high thermal conductivity and high elasticity. For instance, the compressibility ratio of the heat transfer sheet 8 is 50% or more. For instance, silicone material sheet can be used as the heat transfer sheet 8. So-called SARCON can be used for the heat transfer sheet 8. A surface of the heat transfer sheet 8 on the other side (−Z direction) contacts with a plane (XY plane) of the front end part 9 on one side (+Z direction).

The front end part 9 is supplied with ink from the back end part 6. In addition, the front end part 9 includes the nozzles 5 for ejecting ink. The plurality of nozzles 5 are aligned in the main scanning direction. In addition, the front end part 9 includes a manifold damper 91. The manifold damper 91 is a part (space) for storing ink. The manifold damper 91 is connected to each of the nozzles 5.

As illustrated in FIG. 8, the front end part 9 includes the nozzle 5, the manifold damper 91, the individual passage 92, and the piezoelectric actuator 51. For instance, the front end part 9 includes a plurality of stacked metal plates. For instance, the metal plate is made of stainless steel (SUS). FIG. 8 illustrates an example of a cross section of the front end part 9 according to the embodiment. FIG. 8 is an example of a cross section of the nozzle 5 on the YZ plane (taken along the paper sheet conveying direction viewed from the X axis direction).

For convenience sake, the stacked metal plates of the front end part 9 are referred to as a top plate 9*a*, a first damper plate 9*b*, a second damper plate 9*c*, an individual passage plate 9*d*, and a nozzle plate 9*e*, in order from the +Z direction to the −Z direction (from top to bottom). Note that, the front end part 9 including the stacked layers illustrated in FIG. 8 is merely an example. For instance, the number of the stacked metal plates may be larger than the example illustrated in FIG. 8.

The first damper plate 9*b* has a first through hole 93. The second damper plate 9*c* has a second through hole 94. The first through hole 93 and the second through hole 94 penetrate in the Z axis direction (up and down direction). The first through hole 93 and the second through hole 94 extends in the X axis direction (main scanning direction). The first through hole 93 and the second through hole 94 have length in the X axis direction, which is equal to or more than the distance between the most −X direction side nozzle 5 and the most +X direction side nozzle 5 (distance between nozzles 5 on both ends).

When the first damper plate 9*b* and the second damper plate 9*c* are overlaid, the first through hole 93 and the second through hole 94 have the same position in the Y axis direction (sub scanning direction). The top plate 9*a* is overlaid on the +Z direction side (upper side) of the first damper plate 9*b*. The top plate 9*a* becomes lid of the first through hole 93 and the second through hole 94. The part (space) of the first through hole 93 and the second through hole 94 forms the manifold damper 91. The manifold damper 91 is a space for storing ink before ejection. Ink delivered from the back end part 6 enters the manifold damper 91. When ink in the front end part 9 is reduced after ink ejection, ink is supplied to the nozzle 5 through the manifold damper 91.

The nozzle plate 9*e* is a metal plate of the lowest layer (most downward direction) of the front end part 9. The nozzle plate 9*e* is provided with a through hole penetrating in the Z axis direction. This hole part is an ink ejection outlet 54 of the nozzle 5. In addition, the first damper plate 9*b*, the second damper plate 9*c*, and the individual passage plate 9*d* are provided with a through hole forming the individual passage 92. The individual passage 92 is disposed for each of the nozzles 5. As to the part of the individual passage 92, the part between the nozzle 5 and the nozzle 5 is not penetrated in the first damper plate 9*b*, the second damper plate 9*c*, and the individual passage plate 9*d*. In other words, the first damper plate 9*b*, the second damper plate 9*c*, and the individual passage plate 9*d* are provided with the through hole of the individual passage 92 and a wall part, which are disposed alternately at a constant interval in the X axis direction (main scanning direction) viewed from the Z axis direction (up and down direction). An unpenetrated part is the wall part between the individual passages 92. The individual passage 92 is connected to the nozzle 5. All the individual passages 92 are connected to the manifold damper 91. Ink in the manifold damper 91 flows through the individual passage 92 and reaches each of the nozzles 5.

(Heating Plate 7)

Figure 9:
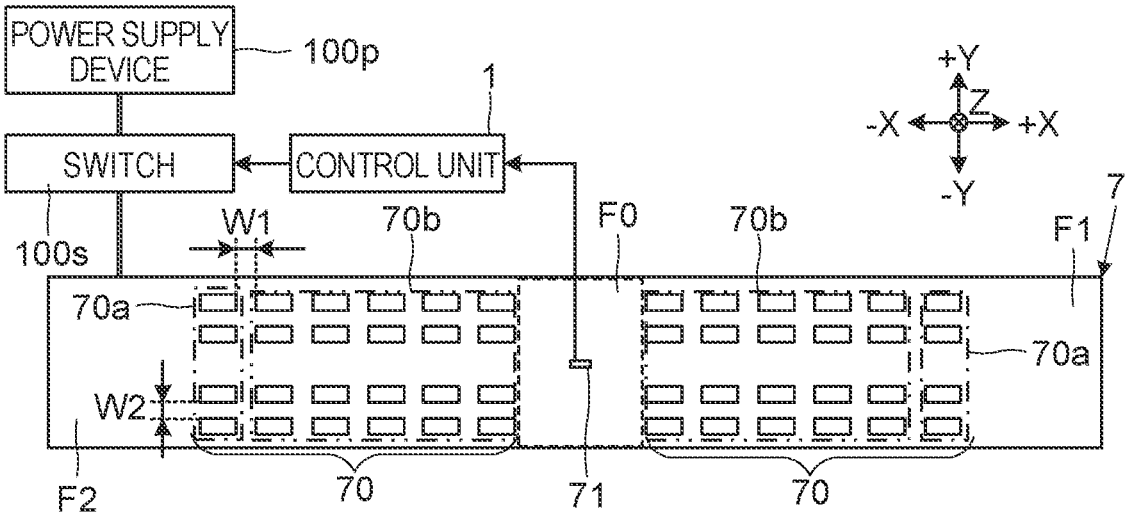
FIG. 9 is a diagram illustrating an example of a heating plate according to the embodiment.

With reference to FIG. 9, an example of the heating plate 7 according to the embodiment is described below. FIG. 9 is a diagram illustrating an example of the heating plate 7 according to the embodiment. FIG. 9 is a diagram of the heating plate 7 viewed from the −Z direction (downward direction).

The heating plate 7 includes the heating elements 70 that produce heat by electricity. Chip resistors can be used as the heating elements 70. Note that the heating element 70 is not limited to the chip resistor. Any element that produces heat by electricity can be used as the heating element 70. Further, the heating plate 7 is a circuit board on which a plurality of the heating elements 70 are mounted. The heating plate 7 can heat all the nozzles 5 (the entire front end part 9) and the entire back end part 6.

The plurality of heating elements 70 are mounted on a surface of the heating plate 7 on the other side (−Z direction) in the Z axis direction (see FIGS. 6 and 7). The other side plane faces the front end part 9 and contacts with the front end part 9 via the heat transfer sheet 8. In addition, one side plane (+Z direction) of the heating plate 7 faces the back end part 6.

FIG. 9 illustrates an example in which the chip resistors are arranged in matrix; 4 in the Y axis direction (sub scanning direction) and 12 in the X axis direction (main scanning direction). FIG. 9 illustrates the example in which 48 chip resistors are mounted as the heating elements 70. Note that the number of the heating elements 70 may be less than or more than 48. For instance, 24 chip resistors on the +Y direction side from the center in the Y axis direction are connected in series. In addition, for example, 24 chip resistors on the −Y direction side from the center in the Y axis direction are connected in series. In other words, the heating plate 7 illustrated in FIG. 9 has two resister circuits, each of which includes 24 chip resistors connected in series.

Here, the other side plane of the heating plate 7 is provided with an isolation area F0. The isolation area F0 is an area in which the heating element 70 is not mounted. In FIG. 9, the rectangular area enclosed by the broken line in the middle part of the heating plate 7 in the X axis direction is the isolation area F0. The isolation area F0 may not be a rectangular area. For convenience sake, on the other side plane of the heating plate 7, the area on one side (+X direction) of the isolation area F0 in the X axis direction is referred to as a first mounting area F1, while the area on the other side (−X direction) of the same is referred to as a second mounting area F2. FIG. 9 illustrates an example in which the same number of the heating elements 70 (chip resistors) are mounted in the first mounting area F1 and in the second mounting area F2. Note that, the number of the heating elements 70 can be different between the first mounting area F1 and the second mounting area F2.

Here, a temperature sensor element 71 is mounted in the isolation area F0. For instance, the temperature sensor element 71 is a chip type thermistor. Using the chip type thermistor, thickness of the heating plate 7 (the dimension in the Z axis direction) can be reduced. Note that the temperature sensor element 71 is not limited to the chip type thermistor. The temperature sensor element 71 may be a thermistor with leads. The temperature sensor element 71 may be an element other than the thermistor for measuring temperature.

The temperature sensor element 71 may be disposed at the center of the isolation area F0 (or at other position). For instance, the temperature sensor element 71 may be disposed so that the center of the isolation area F0 in the XY plane coincides with the center of the temperature sensor element 71, viewed from the Z axis direction. The temperature sensor element 71 contacts with the front end part 9 via the heat transfer sheet 8. The distance between the temperature sensor element 71 and the front end part 9 is the thickness of the heat transfer sheet 8. In other words, the distance between the temperature sensor element 71 and the front end part 9 is less than the distance between the heating element 70 and the temperature sensor element 71. The temperature sensor element 71 measures temperature of the front end part 9. The output of the temperature sensor element 71 varies in accordance with temperature of the front end part 9. The output (output voltage) of the temperature sensor element 71 is supplied to the control unit 1. The control unit 1 recognizes temperature of the front end part 9 on the basis of the output of the temperature sensor element 71.

Further, the distance (smallest distance) in the X axis direction between the heating elements 70 (chip resistors) in the first mounting area F1 and the second mounting area F2 is referred to as a first distance W1. The distance (smallest distance) in the Y axis direction between the heating elements 70 (chip resistors) in the first mounting area F1 and the second mounting area F2 is referred to as a second distance W2. The distance (in the XY plane) between the heating element 70 closest to the isolation area F0 and the temperature sensor element 71 is larger than the first distance W1 and larger than the second distance W2. The temperature sensor element 71 is disposed at a position that is hardly affected by heat generated by the heating element 70. For instance, it may be possible to determine the distance between the temperature sensor element 71 and the heating element 70 through experiment, so that there is no difference between temperature recognized based on the output of the temperature sensor element 71 and actual temperature of the front end part 9, or so that the absolute value of the temperature difference becomes a reference value or less. Alternatively, it may be possible to determine the distance so that heat quantity transferred from the heating element 70 becomes a reference value or less on the basis of thermal conductivity of the material of the heating plate 7. The heating element 70 may be disposed outside the circle having its center at the temperature sensor element 71 and its radius that is the determined distance on the XY plane.

The heating plate 7 is connected to a power supply device 100*p* (see FIG. 9). The power supply device 100*p* and the heating plate 7 are connected with power supplying wires (supply wires). The supply wire is provided with a switch 100*s*. The control unit 1 controls ON/OFF of the switch 100*s*. When heating the ink, the control unit 1 turns on the switch 100*s* so as to supply power to the heating plate 7, and hence each chip resistor is supplied with current (electricity) and is heated. When not heating the ink, the control unit 1 turns off the switch 100*s* so as to stop power supply to the heating plate 7.

Here, heat of the heating plate 7 will escape also from both ends in the X axis direction (main scanning direction) to other members or to air. When power supply to the heating elements 70 is stopped, temperature at the end of the heating plate 7 in the X axis direction tends to be lower than temperature between the heating element 70 and the heating element 70. In the X axis direction, heat quantity of the outermost heating element 70 (first heating element 70*a*) may be set larger than heat quantity of an inner heating element 70 (second heating element 70*b*) inside the first heating element 70*a*. It may be possible to set different resistance values of the first heating element 70*a* and the second heating element 70*b* so that they have different heat quantities. As the resistance value is smaller, current becomes larger. As a result, the heat quantity becomes larger. Therefore, the resistance value of the first heating element 70*a* may be smaller than that of the second heating element 70*b*.

The single heat transfer sheet 8 covers all the heating elements 70 (chip resistors). Note that it may be possible to dispose a plurality of heat transfer sheets 8. In other words, all the heating elements 70 are covered by the heat transfer sheets 8. Further, the heat transfer sheet 8 has elasticity and compressibility so that it can enter between the heating element 70 and the heating element 70. In this way, the heat transfer sheet 8 covers the one side plane of the heating plate 7 without a gap. As a result, heat from the heating plate 7 can be efficiently transferred by the heat transfer sheet 8 in three directions, i.e., the X axis direction, the Y axis direction, and the Z axis direction. As a result, when being supplied with power, the heating plate 7 raises its temperature uniformly. Therefore, the entire front end part 9 and the entire back end part 6 are efficiently heated. The ink in the manifold damper 91 and the nozzles 5 of the front end part 9 can be efficiently heated.

(Ink Temperature Adjustment)

Figure 10:
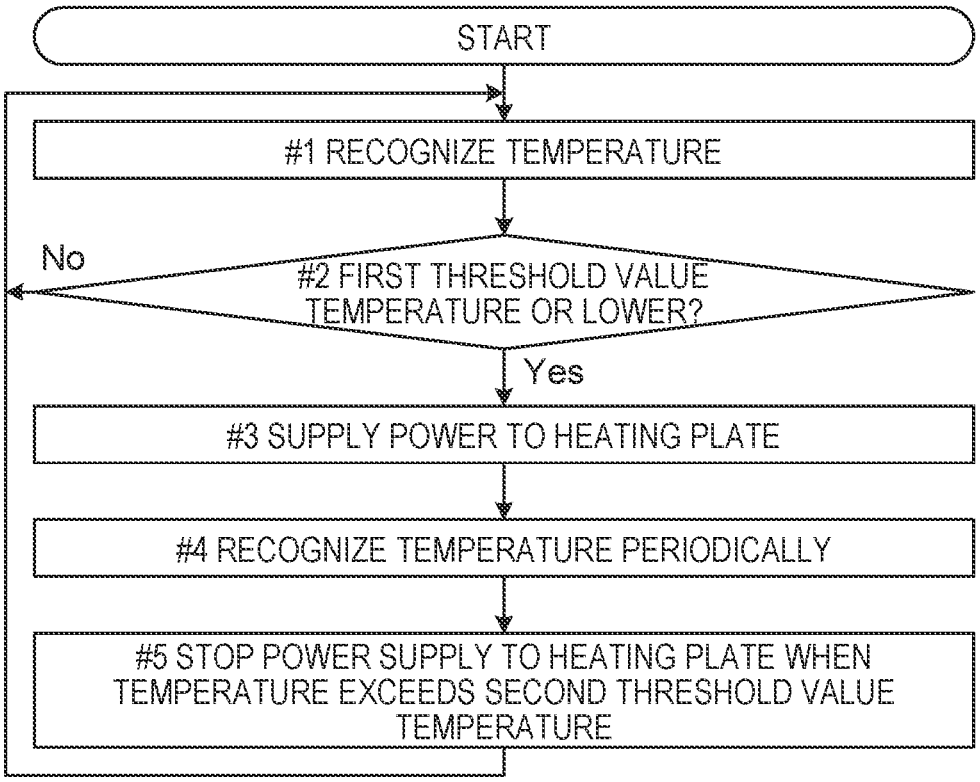
FIG. 10 is a diagram illustrating an example of an ink temperature adjusting process according to the embodiment.

Next, with reference to FIG. 10, an example of ink temperature adjustment using the heating plate 7 according to the embodiment is described below. FIG. 10 is a diagram illustrating an example of an ink temperature adjusting process according to the embodiment.

The control unit 1 controls ON/OFF of power supply to the heating plate 7, controls heating by the heating plate 7, and adjusts ink temperature. As described above, the printer 101 includes a plurality of inkjet heads 100. Each of the inkjet heads 100 includes the head circuit board 50, the back end part 6, the protection plate 80, the adhesive sheet 81, the heating plate 7, the heat transfer sheet 8, and the front end part 9. The control unit 1 controls ON/OFF of power supply to the heating elements 70 for each heating plate 7, so as to adjust temperature of each inkjet head 100. The control unit 1 performs the process illustrated in FIG. 10 for each inkjet head 100.

The process of FIG. 10 starts when the ink temperature adjustment is started. For instance, the process of FIG. 10 may start when activation of the printer 101 is completed after the main power of the printer 101 is turned on. Alternatively, it may start when the operation panel 3 has accepted start of the heating control. Alternatively, it may start when a power saving mode of the printer 101 is canceled. Alternatively, it may start when the communication circuit unit 12 has received print job data.

In addition, end time of the process illustrated in the flowchart of FIG. 10 is determined in advance. The end time may be time when the main power of the printer 101 is turned off. Alternatively, it may be time when the operation panel 3 has accepted end of the heating control. Alternatively, it may be time when the printer 101 starts the power saving mode after conditions of the power saving mode are satisfied. Alternatively, it may be time when the print job has completed.

First, on the basis of the output of the temperature sensor element 71, the control unit 1 recognizes temperature of the front end part 9 (Step #1). Further, the control unit 1 checks whether or not the recognized temperature of the front end part 9 is a first threshold value temperature or lower (Step #2). The first threshold value temperature is determined in advance. The first threshold value temperature is a temperature within a retained temperature range. The retained temperature range is an ink temperature range to be maintained for appropriate ejection. On the basis of ink material, the retained temperature range is determined in advance. For instance, the first threshold value temperature may be the lowest temperature in the retained temperature range. For instance, when the retained temperature range is 20 to 35 degrees Celsius, the first threshold value temperature may be 20 degrees Celsius.

If the recognized temperature is higher than the first threshold value temperature (No in Step #2), the control unit 1 performs Step #1 (returns to Step #1). Specifically, when a predetermined waiting time has elapsed after determining No in Step #2, the control unit 1 performs Step #1. The control unit 1 monitors temperature change without supplying power to the heating plate 7.

If the recognized temperature is the first threshold value temperature or lower (Yes in Step #2), the control unit 1 supplies power to the heating plate 7 (Step #3). In other words, the control unit 1 starts supplying current to the heating plate 7 so as to allow the heating plate 7 to heat the front end part 9 and the back end part 6. After starting heating, the control unit 1 periodically recognizes temperature of the front end part 9 on the basis of the output of the temperature sensor element 71 (Step #4). For instance, the control unit 1 recognizes temperature every one second to a few seconds.

When the recognized temperature of the front end part 9 exceeds a second threshold value temperature, the control unit 1 stops power supply to the heating plate 7 (Step #5). If the heating continues, temperatures of the front end part 9, the back end part 6, and the ink increase. Before long, temperature recognized by the control unit 1 exceeds the second threshold value temperature. The second threshold value temperature is determined in advance. The second threshold value temperature is higher than the first threshold value temperature. The second threshold value temperature is temperature within the retained temperature range. For instance, the second threshold value temperature may be the highest temperature in the retained temperature range. After Step #5, the control unit 1 performs Step #1 (returns to Step #1). When these processes are performed, temperature inside the nozzle 5 can be kept at appropriate temperature.

In this way, the inkjet head 100 and the image forming apparatus (printer 101) according to the embodiment includes the back end part 6, the front end part 9, and the heating plate 7. The back end part 6 includes the ink passage 62. The back end part 6 is fed with ink and delivers the fed ink. The front end part 9 is supplied with ink from the back end part 6. The front end part 9 includes the nozzles 5. The plurality of nozzles 5 are aligned in the main scanning direction so as to eject ink. The heating plate 7 includes the heating elements 70 to produce heat by electricity. The heating plate 7 is disposed between the back end part 6 and the front end part 9. The heating plate 7 conducts heat from the other side of plane and heats the front end part 9. The heating plate 7 conducts heat from one side of plane and heat the back end part 6.

The other side (lower side) of the heating plate 7 heats the front end part 9. As the front end part 9 is surface heated, the heating plate 7 can heat the entire front end part 9. In this way, the entire ink in the front end part 9 can be heated. As the heated ink is supplied to the nozzles 5, ink temperature can be equalized among the nozzles. In other words, ink temperature difference among the nozzles 5 just before ejection can be reduced as much as possible.

In addition, the heating plate 7 also heats the back end part 6. The back end part 6 is a part for supplying ink to the front end part 9. The front end part 9 is supplied with ink heated by the back end part 6. Before the ink is supplied to the front end part 9, the back end part 6 can heat (preheat) the ink. Replenishment of low temperature ink to the front end part 9 can be prevented. Even if ejection frequency is different among the nozzles 5, ink temperature difference among the nozzles 5 is not increased.

Further, the single heating plate 7 can heat both the front end part 9 and the back end part 6. Compared with the case where heaters are respectively disposed for the front end part 9 and for the back end part 6, manufacturing cost can be reduced. In addition, space necessary for disposing the heater can also be reduced.

The heating plate 7 is a single circuit board on which the plurality of heating elements 70 are mounted. The single heating plate 7 heats all the nozzles 5. Only the single heating plate 7 can heat all the nozzles 5 (the entire front end part 9). In other words, the structure is simple. A plurality of tiny heaters in the conventional structure are not needed. Therefore, the structure of the inkjet head 100 can be simplified, and its manufacturing cost can be reduced.

The plurality of heating elements 70 are mounted on the other side plane of the heating plate 7 so as to face the front end part 9. One side plane of the heating plate 7 faces the back end part 6. The heating elements 70 can be arranged on the other side (lower side) plane of the heating plate 7. As the heating elements 70 face the front end part 9, the front end part 9 can be efficiently heated. In addition, heat on one side (upper side) of the heating plate 7 can also heat the back end part 6.

The inkjet head 100 includes the heat transfer sheet 8. The heat transfer sheet 8 is disposed between the heating plate 7 and the front end part 9. The plurality of heating elements 70 are mounted on the other side plane of the heating plate 7. The other side plane of the heating plate 7 faces the front end part 9. One side plane of the heat transfer sheet 8 contacts with the plurality of heating elements 70. The other side plane of the heat transfer sheet 8 contacts with the front end part 9. The heat transfer sheet 8 transfers heat generated by each of the heating elements 70. The heat transfer sheet 8 allows heat to spread over the entire heating plate 7. In this way, temperature on the surface of the heating plate 7 becomes uniform. In other words, temperature distribution of the heating plate 7 becomes smooth. The entire front end part 9 contacting with the heating plate 7 via the heat transfer sheet 8 can be uniformly heated. There is no deviation of heating.

The heat transfer sheet 8 enters between the heating element 70 and the heating element 70. The heat transfer sheet 8 also absorbs heat in the gap between the heating element 70 and the heating element 70. The heat transfer sheet 8 efficiently absorbs heat generated by the heating elements 70. The heat transfer sheet 8 transfers and spreads heat over the plane of the heating plate 7. The heating plate 7 raises temperature overall without unevenness. The front end part 9 and the back end part 6 can be efficiently heated.

The plurality of heating elements 70 are mounted and aligned in the main scanning direction. The first heating element 70*a* has a larger heat quantity than the second heating element 70*b*. The first heating element 70*a* is the outermost heating element 70 in the main scanning direction. The second heating element 70*b* is the inner heating element 70 inside the first heating element 70*a* in the main scanning direction. Viewing the plane of the heating plate 7 from the vertical direction (Z axis direction), heat tends to escape from the periphery part of the heating plate 7. Heat escapes less easily from the inside part of the heating plate 7 than from the outside part. The heating plate 7 has a part where heat easily escapes. Further, heat quantity of the heating element 70 (first heating element 70*a*) in the periphery part of the heating plate 7 is larger than that of the inner heating element 70 (second heating element 70*b*). Heat quantity of the heating element 70 disposed in the part where heat easily escapes can be set large. As a result, there is no extremely low temperature part, and a temperature difference on the plane of the heating plate 7 is reduced. In this way, the entire front end part 9 can be uniformly heated. Ink in all the nozzles 5 can be heated without exception. In addition, the entire back end part 6 can be heated.

The plurality of heating elements 70 are mounted and aligned in the main scanning direction and also in the sub scanning direction. The heating elements 70 can be arranged so that the entire heating plate 7, the entire front end part 9, and the entire back end part 6 can be uniformly heated.

The heating plate 7 includes the temperature sensor element 71. The temperature sensor element 71 outputs an output value corresponding to temperature of the front end part 9. The temperature sensor element 71 can be mounted on the heating plate 7. The temperature sensor element 71 can be mounted at a position very close to the front end part 9. Temperature of the front end part 9 can be measured. Furthermore, manufacturing cost can be reduced compared with the case where the temperature sensor element 71 and the heating plate 7 are disposed separately. In addition, manufacturing process can be simplified.

The plurality of heating elements 70 and the temperature sensor element 71 are mounted on the other side plane of the heating plate 7. On the other side plane of the heating plate 7, there is the isolation area F0 where no heating element 70 is disposed. The temperature sensor element 71 is mounted in the isolation area F0. A special area can be disposed on the other side plane (lower side) of the heating member. The temperature sensor element 71 can be disposed at a position that is hardly affected by heat of the heating element 70. Temperature of the front end part 9 can be measured accurately.

The temperature sensor element 71 can be mounted at the center of the isolation area F0 (or at a non-center position). The temperature sensor element 71 can be mounted at a position apart as far as possible from the heating elements 70. The temperature sensor element 71 can be mounted at a position that is least affected by heat of the heating elements 70 on the other side (lower side) plane of the heating plate 7. Accurate temperature of the front end part 9 can be sensed.

The distance between the temperature sensor element 71 and the heating element 70 in the main scanning direction is more than the first distance W1 or the second distance W2. The first distance W1 is a distance between the heating element 70 and the heating element 70 that are adjacent in the main scanning direction. The second distance W2 is a distance between the heating element 70 and the heating element 70 that are adjacent in the sub scanning direction. The distance between the heating element 70 and the temperature sensor element 71 can be secured.

The inkjet head 100 and the printer 101 include the control unit 1 that recognizes temperature of the front end part 9 on the basis of the output of the temperature sensor element 71. The temperature of the front end part 9 can be recognized on the basis of the output of the temperature sensor element 71.

If the temperature of the front end part 9 recognized on the basis of the output of the temperature sensor element 71 is a predetermined first threshold value temperature or lower, the control unit 1 supplies power to the heating plate 7. If the temperature of the front end part 9 recognized from the output of the temperature sensor element 71 is higher than a predetermined second threshold value temperature, the control unit 1 stops power supply to the heating plate 7. The first threshold value temperature is lower than the second threshold value temperature. Electricity supply (power supply) to the heating plate 7 can be automatically turned on and off on the basis of the output of the temperature sensor element 71. The power supply to the heating plate 7 can be controlled so that the temperature is higher than the first threshold value temperature and is the second threshold value temperature or lower. As a result, ink temperature can be maintained at a temperature within an appropriate temperature range.

The heating elements 70 may be chip resistors. As the chip resistor is used for the heating element 70, the heating plate 7 can be manufactured in low cost. Thickness (in the Z axis direction) of the heating plate 7 can be reduced.

The front end part 9 includes the manifold damper 91. The manifold damper 91 stores ink and is connected to each of the nozzles 5. Ink to be supplied to the nozzles 5 can be stored in the manifold damper 91. The heating plate 7 can heat ink in the manifold damper 91. The heated ink can be delivered from the manifold damper 91 to the nozzles 5. Ink temperature (in the nozzles 5) before ejection can be equalized.

According to the present disclosure, ink can be heated so that ink temperature difference in the nozzles before ejection can be eliminated. By equalizing ink temperature among the nozzles before ejection, deterioration of image quality due to ink temperature can be eliminated. It is possible to provide the inkjet head having high image quality.

Although the embodiment of the present disclosure is described above, the scope of the present disclosure is not limited to this. The present disclosure can be variously modified for implementation without deviating from the spirit thereof.

The present disclosure can be applied to inkjet heads for ejecting ink.

What is claimed is:

1. An inkjet head comprising:

a back end part including an ink passage, configured to be fed with ink and to deliver the fed ink;

a front end part configured to be supplied with the ink from the back end part, the front end part including a plurality of nozzles aligned in a main scanning direction so as to eject ink; and a heating plate including a heating element to produce heat by electricity, the heating plate being disposed between the back end part and the front end part, so as to heat the front end part by conducting heat from the other side of plane, and to heat the back end part by conducting heat from one side of plane.

2. The inkjet head according to claim 1, wherein the heating plate is a circuit board on which a plurality of the heating elements are mounted, and the single heating plate heats all the nozzles.

3. The inkjet head according to claim 2, wherein the plurality of heating elements are mounted on the other side plane of the heating plate, so as to face the front end part, and one side plane of the heating plate faces the back end part.

4. The inkjet head according to claim 2, further comprising a heat transfer sheet disposed between the heating plate and the front end part, wherein the plurality of heating elements are mounted on the other side plane of the heating plate, the other side plane of the heating plate faces the front end part, one side plane of the heat transfer sheet contacts with the plurality of heating elements, and the other side plane of the heat transfer sheet contacts with the front end part.

5. The inkjet head according to claim 4, wherein, the heat transfer sheet enters between the heating element and the heating element.

6. The inkjet head according to claim 2, wherein the plurality of heating elements are mounted and aligned in the main scanning direction, a first heating element has a larger heat quantity than a second heating element, the first heating element is an outermost heating element in the main scanning direction, and the second heating element is an inner heating element inside the first heating element in the main scanning direction.

7. The inkjet head according to claim 2, wherein the plurality of heating elements are mounted and aligned in the main scanning direction and also in the sub scanning direction.

8. The inkjet head according to claim 1, wherein the heating plate includes a temperature sensor element configured to output an output value corresponding to temperature of the front end part.

9. The inkjet head according to claim 8, wherein distance between the temperature sensor element and the heating element in the main scanning direction is larger than a first distance and larger than a second distance, the first distance is distance between adjacent heating elements in the main scanning direction, and the second distance is distance between adjacent heating elements in a sub scanning direction.

10. The inkjet head according to claim 8, further comprising a control unit configured to recognize temperature of the front end part based on output of the temperature sensor element.

11. The inkjet head according to claim 10, wherein when temperature of the front end part recognized based on the output of the temperature sensor element is a predetermined first threshold value temperature or lower, the control unit supplies power to the heating plate, when temperature of the front end part recognized based on the output of the temperature sensor element is higher than a predetermined second threshold value temperature, the control unit stops power supply to the heating plate, and the first threshold value temperature is lower than the second threshold value temperature.

12. The inkjet head according to claim 1, wherein the heating plate includes a temperature sensor element, the temperature sensor element outputs an output value corresponding to temperature of the front end part, the plurality of heating elements and the temperature sensor element are mounted on the other side plane of the heating plate, the other side plane of the heating plate is provided with an isolation area in which the heating element is not mounted, and the temperature sensor element is mounted in the isolation area.

13. The inkjet head according to claim 12, wherein the temperature sensor element is mounted at the center of the isolation area.

14. The inkjet head according to claim 1, wherein, the heating element is a chip resistor.

15. The inkjet head according to claim 1, wherein
the front end part includes a manifold damper, and
the manifold damper stores ink and is connected to each of the nozzles.

* * * * *